US005198611A

United States Patent [19]

Larsen

[11] Patent Number: 5,198,611

[45] Date of Patent: Mar. 30, 1993

[54] EXPLOSION SUPPRESSION DEVICE WITH INTRINSICALLY SAFE CIRCUITRY

[75] Inventor: Theodore E. Larsen, Edina, Minn.

[73] Assignee: Advanced Innovations, Inc., Minneapolis, Minn.

[21] Appl. No.: 763,978

[22] Filed: Sep. 23, 1991

[51] Int. Cl.[5] ..... A62C 3/04; A62C 37/10

[52] U.S. Cl. ..... 102/293; 89/1.14; 169/47; 169/60

[58] Field of Search ..... 89/1.14; 102/293; 169/26, 28, 47, 54, 56, 58, 60, 61, 66

[56] References Cited

U.S. PATENT DOCUMENTS

| | | | |
|---|---|---|---|
| 2,766,832 | 10/1956 | Mathison | 89/1.14 |
| 2,783,845 | 3/1957 | Mathisen | 169/54 |
| 2,867,282 | 1/1959 | Bagno et al. | 169/61 |
| 3,091,365 | 5/1963 | Horner et al. | 169/26 |
| 3,741,309 | 6/1973 | McCullock | 169/66 |
| 3,831,682 | 8/1974 | Calcaro | 169/37 |
| 3,896,881 | 7/1975 | DeBoer | 169/66 |
| 3,971,443 | 7/1976 | Zenker | 169/39 |
| 4,022,131 | 5/1977 | Redding | 102/220 |
| 4,194,572 | 5/1980 | Thery et al. | 169/66 |
| 4,248,309 | 2/1981 | Hofle et al. | 169/47 |
| 4,281,717 | 8/1981 | Williams | 169/66 |
| 4,356,868 | 11/1982 | Bentley et al. | 169/26 |
| 4,487,266 | 12/1984 | Gillis et al. | 169/66 |
| 4,815,694 | 3/1989 | Ferren et al. | 169/61 |
| 4,889,189 | 12/1989 | Rozniecki | 169/26 |
| 5,052,494 | 10/1991 | Larsen | 169/60 |

*Primary Examiner*—Charles T. Jordan

[57] ABSTRACT

A pressure responsive and pressure operative device which includes an intrinsically safe detonation circuitry particularly designed for the suppression of explosive situation where the initial indication of a developing explosion and subsequent fire is an increase in pressure within a protected volume which is normally related to a building or other structure. The device includes a directed housing serving as a cannon which holds an extinguishant containing canister which incorporates an explosive charge for producing a rapidly rising pressure within the canister for substantially instantaneous discharge of extinguishant from the canister and instantaneous release of propelling fluid pressure from a pressure supply tank for additional extinguishant propulsion. The unit is operative with only low voltage and pressure thus making the same intrinsically safe.

10 Claims, 3 Drawing Sheets

4
4
E
E1
28
33
35
35a
30
36
13b
14a
29
29a
25
32
31
(Shielded)
40
43b
13a
13
(Junction Box)
42
41
11
14
27
26
Detector
20
16
15
15a
56
56a
57a
57
40
20a
43a
17
16a
53
52
54
57b
55
12a
50
51
12

EXPLOSION SUPPRESSION DEVICE WITH INTRINSICALLY SAFE CIRCUITRY

RELATED APPLICATIONS

Applicant has currently on file with the United States Patent Office an application entitled Method for Explosive Delivery & Distribution of Fire Related Materials & Safe and Arm Circuitry. Therefore, Ser. No. 699,509, Filed May 14, 1991 and has also filed an application entitled Explosion Suppression Device, Ser. No. 504,386, Filed Apr. 4, 1990, now U.S. Pat. No. 5,052,494. Both of these applications are for devices directed to explosion and fire control.

FEDERAL SPONSORSHIP

This invention is not made under any Federally sponsored research and development arrangement nor any other sponsored research and development arrangement which should be noted.

FIELD OF THE INVENTION

This invention relates generally to a device directed to the suppression of an explosion or explosions within a protected volume, said volume being representative of a process enclosure, building or structure, and more specifically to a device which senses increases in pressure within the volume which is indicative of a developing explosion and resultant fire for the propulsion of housed extinguishant material prior to the generation of destructive pressures by such explosion, for suppression of the same with sensing and actuation of the device obtained through the use of fluid pressure and low voltage actuation circuitry.

SUMMARY OF THE INVENTION

A device for suppressing explosions within a protected area such that the developing explosion is suppressed prior to the occurrence of destructive pressures in the protected volume. The device includes a directed, longitudinally extending housing, termed a cannon, for housing a canister containing an extinguishing material or materials and a detonating device. The cannon is arranged to face the area to be protected and communicate therewith and is therefore responsive to pressures within such area. Upon an increase in pressure within the protected enclosure a pressure responsive diaphragm is moved to trip an actuating switch. The detonating device is triggered by actuation of this switch which switch simply reverses polarity of the detonating circuit which initiates a capacitor discharge and explosive ignition of the detonating device.

Simultaneous with such explosive ignition, the detonating devices cause release of high pressure gas or air from a storage tank communicating with the cannon, and the inrushing gas or air assists in propelling the contents of the canister forward against a knife device which insures dispersion of the extinguishant through the pressure diaphragm into the protected volume.

The simultaneous action of detonation and release of gas insures total breakup of the canister contents with expulsion of the extinguishant into the protected volume with insurance that possibly hardened extinguishant is broken and pulverized for maximum effectiveness of the extinguishing material.

The device further includes the aspect of extinguishant additives. The canister may house the primary extinguishant and an activating element which are normally housed separately but which, upon detonation, will combine to result in a more positive extinguishing combination.

The cannon is designed for simple reloading after use.

The circuit is continually powered from a low voltage source which maintains the capacitor of the circuit in charged condition until the circuit polarity is reversed. All components of the circuit operate at low voltage and the capacitence, resistance and inductance values are selected so that the entire unit is intrinsically safe.

BACKGROUND AND OBJECTS OF THE INVENTION

As stated, the applicant has filed applications for patent which are related to this invention in that they are similarly directed to explosion suppression devices. This invention includes a polarity reversing device described and claimed in U.S. Pat. No. 4,022,131 to Robert J. Redding, issued May 10, 1977 entitled Electrically Operated Release Apparatus. Applicant is a licensee under this patent and the circuit thereof is used in this disclosure.

Previously cited and recognized U.S. Patents include patents to De Boer, U.S. Pat. No. 3,896,881, Bagno et al, U.S. Pat. No. 2,867,282, Gillis et al U.S. Pat. No. 4,487,266, Williams, U.S. Pat. No. 4,281,717, Thery et al, U.S. Pat. No. 4,194,572, McCulloch, U.S. Pat. No. 3,741,309, Mathisen, U.S. Pat. No. 2,783,845, Bentley et al, U.S. Pat. No. 4,356,868, Ferren et al, U.S. Pat. No. 4,815,694, Rozniecki, U.S. Pat. No. 4,889,189, Horner et al, U.S. Pat. No. 3,091,365, Calcaro, U.S. Pat. No. 3,831,682, Hofle et al, U.S. Pat. No. 4,248,309 and Zenker, U.S. Pat. No. 3,971,443. Although all of these patents relate in some manner to fire control apparatus, none of them provide a device that would be considered by one skilled in the art as being pertinent to the question of patentability of the applicant's invention.

Applicant's previous devices have incorporated various detonating devices and various valve control devices for the release of propulsion gas which devices react relatively simultaneously to increases in pressure within volumes to be protected, with it being well known that such pressure increases above a defined threshold are positive indication that an explosion and fire are developing within the monitored volumes. The structure of this device has as its main objective to suppress such an explosion and prevent such fire.

With applicant's device as disclosed herein the primary object is carried out through a detonating circuit which is designed for intrinsically safe operation in hazardous environments and which is continually maintained "at the ready" through continuous charging of a capacitor which releases its charge for detonation upon polarity reversal as caused by a switch arranged to be switched by an increase in pressure within the protected volume.

Further with applicant's device the primary objective is carried out through responsive means to open communication with an air or gas supply which supply cooperates with the explosive force of the detonating circuit to propel extinguishant into the protected area with all steps of detonation and propulsion carried out in such rapid response to pressure rise as to extinguish a forming fire ball.

Further with applicant's device the extinguishant is acted upon by a variety of forces to insure complete and thorough dispersal into the protected area. Should the extinguishant, for any reason, become "packed" by settling and vibration, the various forces insure complete breakup thereof for particulate and effective dispersal.

Applicant's device then, as a primary object, is intrinsically safe to eliminate hazards associated with high energy circuits often used to power such equipment and is rapidly responsive to factors indicative of the formation of an explosion so as to prevent the continuous chain of reactions associated with explosions and fires within volumes such as grain elevators and the like.

These and other objects and advantages of the applicant's invention will more fully appear from a consideration of the accompanying drawings and description of the invention.

DESCRIPTION OF A PREFERRED FORM OF THE INVENTION

Figure 1:
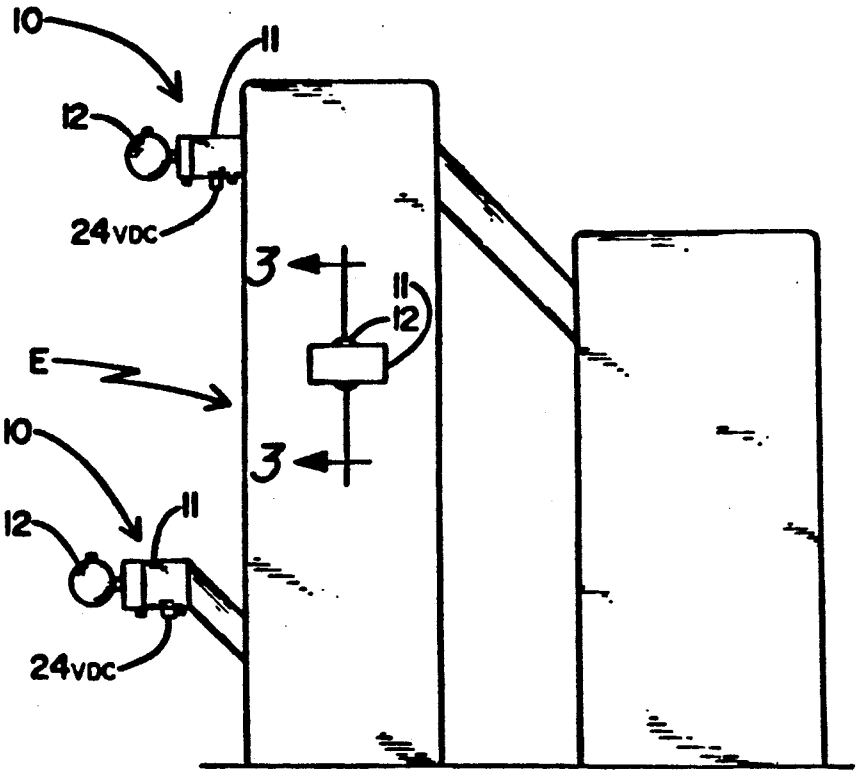
FIG. 1 is simplified schematic view of a grain elevator structure which includes a plurality of applicant's protection devices.
Figure 3:
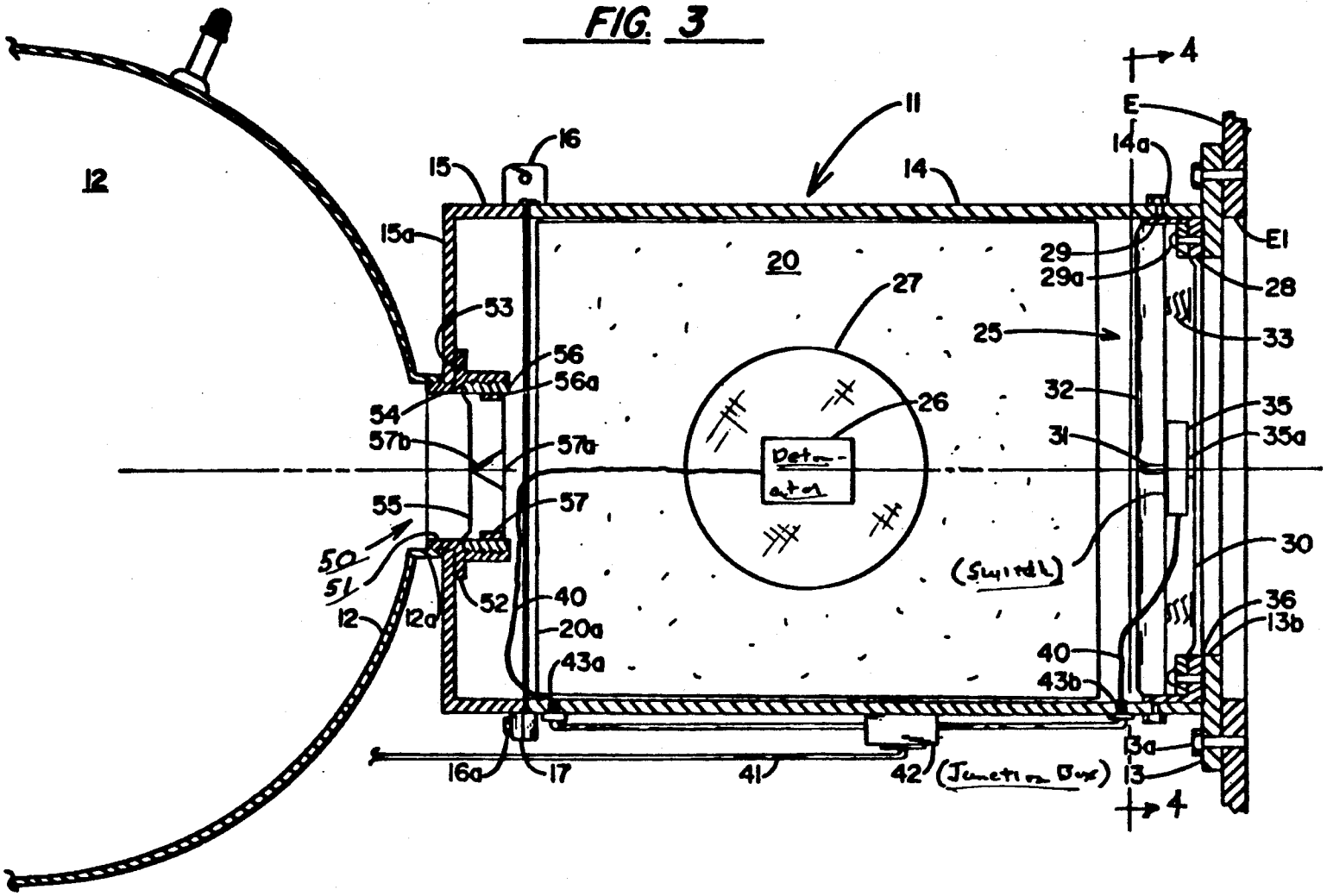
FIG. 3 is a longitudinal cross section of one of applicant's units as taken substantially along Line 3—3 of FIG. 1.

In accordance with the accompanying drawings, applicant's cannon and associated air supply is generally designated 10 with the cannon portion of the invention specifically designated 11 and the air supply specifically designated 12. As illustrated in FIG. 1, a number of the units 10 are particularly located on the exterior of a volume to be protected such as a grain elevator E. As illustrated in FIG. 3, an opening El is provided through the wall of the elevator E and the applicant's uit 10 is attached directly thereto through a flange 13 and appropriate fastening devices 13*a*. This entire unit is sealed to the elevator E skin such that internal pressures are transmitted to the unit 10. Flange 13 is provided with an aperture 13*b* therethrough to provide pressure communication to the interior of the cannon 11.

The cannon 11 body includes a barrel portion 14 and a hinged cover or cap 15, the hinge being designated 16 and having at least one locking member 16*a*. A seal 17 is provided between cap 15 and barrel 14.

The explosive, extinguishant containing canister 20 is provided within barrel 14 and is of a size such that the contents are propelled therefrom forwardly through the aperture 13*b* of flange 13 and the opening E1 through the wall of the protected volume E by pressure acting against the rear 20*a* thereof. The canister 20 is of a frangible material to allow rupture of both ends while the cylindrical outer casing is substantially retained within the cannon barrel.

Located within canister 20 is a quantity of extinguishant and a detonating device 26. An additive material containing housing 27 also illustrated in FIG. 3 provides an alternative extinguishant feature. Often it is desirable to provide an activator as well as a primary extinguishing material. In the form of FIG. 3, an arrangement to accomodate this alternative is provided. Housing 27 would contain an activator or necessary element for addition to the primary extinguishant of canister 20 and upon excitation of the detonator 26, the housing 27 would be destroyed and the material contained therein would be added to the primary extinguishant of canister 20.

Figure 5:
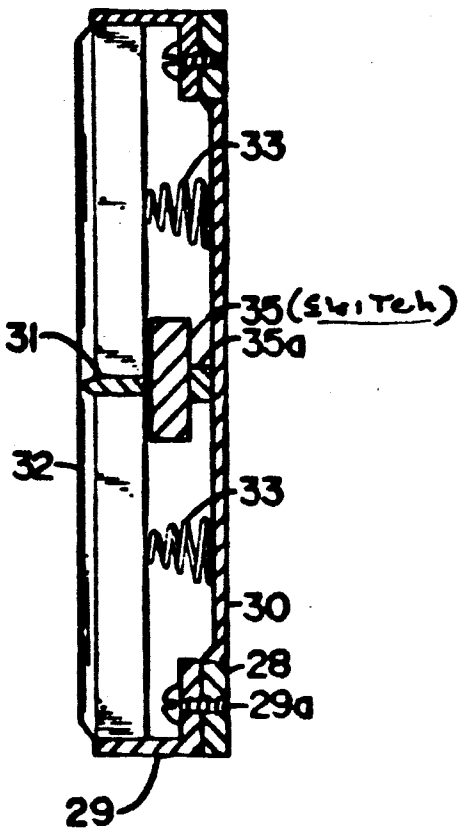
Figure 4:
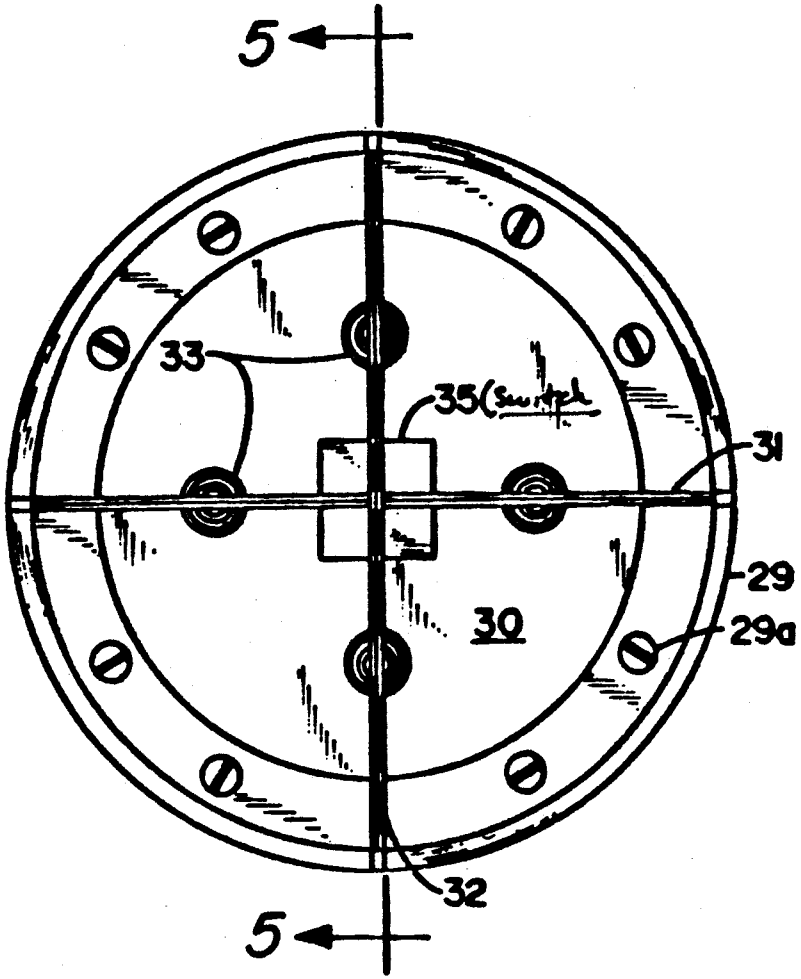
FIG. 4 is a view taken substantially along Line 4—4 of FIG. 3 illustrating only the replaceable pressure sensing diaphragm unit which incorporates the primary switch and the canister breaking bars or knives; and, FIG. 5 is a section taken substantially along Line 5—5 of FIG. 4.

A pressure sensing diaphragm and canister rupture device is generally designated 25 and is best illustrated in FIGS. 4 and 5 and as illustrated in FIG. 3, is located in its operative position within the barrel 14 of the applicant's unit 10 adjacent the flange opening 13*a*. As illustrated, this rupture device 25 includes a first ring 28 and a second L-shaped ring 29 joined together through connective devices 29*a* for clamping of a diaphragm 30 therebetween. Diaphragm 30 is exposed to the interior of the protected volume E and therefore will be responsive to pressures therein. A number of cutter bars 31, 32 span between the L-shaped ring 29 to insure fragmentation of the end cap of canister 20 and dispersion of extinguishant as it is pressured therepast into the protected volume E. These bars 31, 32 positively insure complete breakup of the end cap of canister 20 and insure that the various extinguishants contained therein are broken or pulverized for proper discharge into the protected volume E.

A plurality of springs 33 are arranged between diaphragm 30 and the bars 31, 32 and are selected in combination with the diaphragm strength to respond to an explosion indicating pressure within the protected volume E. A switch 35 is located between bars 31, 32 and diaphragm 30 with the actuator portion 35*a* thereof being positioned to reverse the circuit of FIG. 2 upon predetermined movement of diaphragm 30.

Electrical communication is maintained between switch 35 and detonator 26 through low voltage transmission connective wire 40 with low voltage input provided through conductors 41 and junction box 42 exteriorally of the barrel 14 with appropriate sealing grommets 43*a*, 43*b* provided for passage of conductors through barrel 14.

Rupture device 25 is maintained in position within barrel 14 by locating members 14*a* extending through the sides thereof against L-shaped ring 29. A seal 36 may be provided between ring 28 and flange 13 but in actual use this seal may be eliminated to balance ambient pressure changes within the protected volume and the volume within the barrel 14.

Pressurizing and expelling gas or air is provided from supply 12 through valve mechanism 50. The air supply 12 is provided with an internally threaded, arcuate boss 12*a* which receives an attachment, locking plug 51 therein to clamp the end 15*a* of cap 15 between a radial flange 52 thereof and the end of such boss 12*a*. A seal 53 may be provided between flange 52 and the interior of cap end 15*a*. Interiorally of plug 51, a diaphragm receiving shoulder 54 is provided and rupturable diaphragm 55 is received thereagainst and held thereto by bearing 56. A longitudinally slidable ring 57 is provided within bearing 56 and this ring 57 is held in puncturing position to diaphragm 55 through retainer 56*a*. This ring 57 is closed at one end as by plate 57*a* which carries a set of puncturing knives 57*b*. Upon explosion of detonator 26 the resulting explosive force will force the cutting knives 57*b* through diaphragm 55 allowing high pressure air or gas from supply tank 12 to enter the barrel 14 for propulsion of extinguishant housed in canister 20 into the protected volume. Ring 57 is driven past the temporary restraints 56a by air or gas expelled from supply tank 12.

Figure 2:
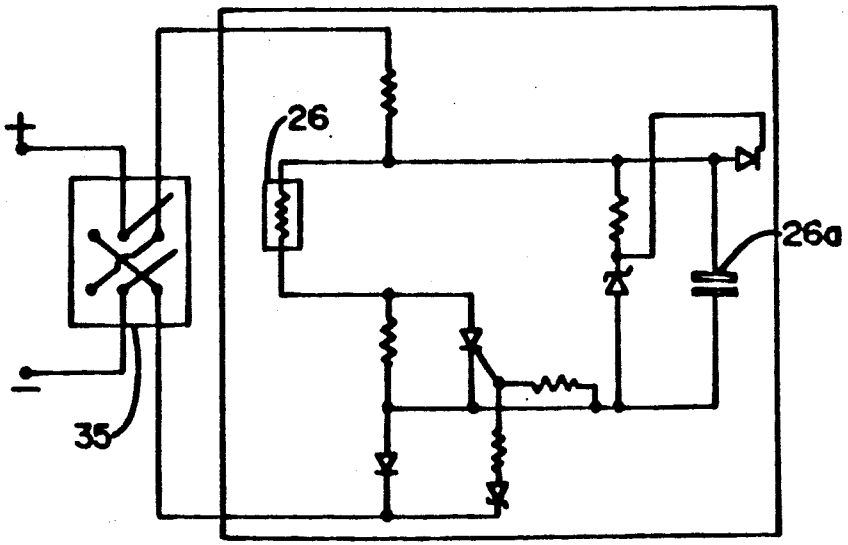
FIG. 2 is a schematic drawing of the Redding polarity switching circuit.

The operation of the circuitry of FIG. 2 is as explained in the Redding reference. The primary aspect of the circuit is to charge capacitor 26a from a low voltage supply and this is accomplished continuously through switch 35. The diode controlled circuit allows such continuous charging without discharge and upon switching of switch 35 by actuation by diaphragm 30, the polarity of the circuit is reversed to provide for capacitor discharge and current flow to the detonator 26 for discharge thereof.

Upon detonator discharge, the still contained explosive force causes rupture of the gas or air supply and the combination of such supply and explosive force properly propels the extinguishant through the sacrificial diaphragm 30 into the protected volume. Applicant has found the illustrated and described device to be timely reactive so as to "catch" the fireball in formation in the early stages of an explosion.

Applicant has provided an extinguishing unit to control developing explosions and fires which unit is intrinsically safe due to the low voltages and circuit components utilized in its operation.

Applicant has also provided a unit which is easily rearmed in that it is only necessary to open the hinged cap 15 for total access to the interior of the cannon for reloading and rearming the same. All operations are capable of being performed from the exterior of the protected volume.

What I claim is:

1. An explosion suppression device for propelling extinguishing materials into a protected volume which volume is normally representative of a structure or other housing, said device including:

a. a propelling cannon providing a barrel having an open end and a closed end, said open end communicating with the housing;

b. a rupturable canister positioned within said barrel arranged and constructed for confining a quantity of extinguishing material;

c. an electrically responsive explosive detonator arranged in rupturing relationship to said canister to cause rupture thereof upon explosion;

d. said open end of said barrel including pressure sensing means responsive to an increase in pressure within said housing;

e. electrical switching means arranged for actuation by said pressure sensing means;

f. an electrical circuit including at least said switch means and said detonator;

g. means for supplying electrical energy to said circuit whereby actuation of said switch means in response to an increase in pressure in said housing provides electrical energy to said detonator for ignition and explosion thereof and propelling of the extinguishing material through said open end of said barrel into the housing.

2. The explosion suppression device as set forth in claim 1 wherein said pressure sensing means includes a shiftable diaphragm arranged to close said open end of said barrel.

3. The explosion suppression device as set forth in claim 2 and said diaphragm being rupturable in response to explosion of said detonator and passage of extinguishing material through said open end of said barrel.

4. The explosion suppression device as set forth in claim 1 and canister contacting and rupturing means provided adjacent said open end of said barrel insuring total rupture of at least canister end caps and extinguishing material breakup as the same is moved toward and through said open end of said barrel.

5. The explosion suppression device as set forth in claim 1 and said electrical circuit including chargeable capacitor means, said circuit arranged and constructed for continuous charging of said capacitor and said switching means permitting discharge of said capacitor and flow of electrical energy to said detonating means upon pressure actuation of said switching means.

6. An explosion suppression device as set forth in claim 5 wherein said electrical circuit includes diode means providing constant capacitor charging and permitting discharge thereof upon actuating of said switching means.

7. An explosion suppression device as set forth in claim 6 and said electrical energy supplied to said electrical circuit being 24 V. direct current.

8. The explosion suppression device as set forth in claim 1 wherein said quantity of extinguishing material includes:

a. at least a pair of isolated extinquishant components; and, b. said components combining upon ignition and explosion of said detonator.

9. The explosion suppression device as set forth in claim 1 and:

a. a source of pressurized air communicating with said barrel and arranged and constructed to propel at least portions of said canister and contained extinguishant through said open end thereof; and, b. pressure responsive valve means controlling communication between said barrel and said gas supply, responsive to explosion of said detonator, opening communication between said gas supply and said barrel upon such detonator ignition and explosion.

10. The explosion suppression device as set forth in claim 9 wherein said pressure responsive valve includes a rupturable diaphragm and a pressure responsive diaphragm rupturing means associated therewith for rupture of said diaphragm upon ignition and explosion of said detonator.

* * * * *